United States Patent [19]

Chelminski

[11] 4,377,355

[45] Mar. 22, 1983

[54] QUIET BOUNCER DRIVER THRUSTER METHOD WITH PRESSURIZED AIR CHAMBER ENCIRCLING MASSIVE BOUNCING PISTON

[75] Inventor: Stephen V. Chelminski, West Redding, Conn.

[73] Assignee: Bolt Technology Corporation, Norwalk, Conn.

[21] Appl. No.: 62,420

[22] Filed: Jul. 31, 1979

[51] Int. Cl.[3] ..... E02D 7/10

[52] U.S. Cl. ..... 405/232; 173/1; 173/135

[58] Field of Search ..... 173/1, 135, 131, 139; 405/232; 91/325

[56] References Cited

U.S. PATENT DOCUMENTS

| | | | |
|---|---|---|---|
| 687,851 | 12/1901 | Rhodes | 173/135 |
| 3,604,519 | 9/1971 | Chelminski . | |
| 3,646,598 | 2/1972 | Chelminski . | |
| 3,714,789 | 2/1973 | Chelminski . | |
| 3,721,095 | 3/1973 | Chelminski . | |
| 3,750,609 | 8/1973 | Chelminski . | |
| 3,788,402 | 1/1974 | Chelminski . | |
| 3,817,335 | 6/1974 | Chelminski . | |
| 3,847,230 | 11/1974 | Blomquist | 173/131 X |
| 3,958,647 | 5/1976 | Chelminski . | |
| 4,098,356 | 7/1978 | Last | 173/131 |

FOREIGN PATENT DOCUMENTS 1396575 6/1975 United Kingdom .

*Primary Examiner*—Robert Mackey

*Attorney, Agent, or Firm*—Parmelee, Bollinger & Bramblett

[57] ABSTRACT

A massive piston, which might be called a "ram", except that it does not strike anything during operation, reciprocates with bouncing action up and down within a cylinder. An annular pressurized gas storage chamber encircles the piston and travels up and down with it. Pressurized gas is continuously supplied into this movable chamber to be temporarily stored therein. As the piston descends toward the lower end of the cylinder, pressurized gas from this travelling chamber is automatically suddenly allowed to bypass the lower portion of the piston, thereby injecting the pressurized gas into a bounce chamber between the descending piston and a bottom assembly. When this pressurized gas rushes through the bypass, it forces an exhaust valve closed. The bypass includes two vertically spaced sets of gas feed ports communicating into the cylinder, and as the piston continues descending closer to the bottom assembly, the injected pressurized gas is suddenly trapped becoming further compressed as a cushion with great pressure multiplication below the descending piston, thereby producing a powerful driving thrust while bouncing the piston upwardly in a powerful bouncing action. As the piston ascends, additional pressurized gas automatically bypasses from the storage chamber into the cylinder, and its expansion aids in propelling the piston up relatively high. The ascending piston allows gas expansion, until pressure has dropped approximately to atmospheric, thereby allowing the exhaust valve to open. When this valve opens, the piston is near the top of its stroke, and the cycle repeats.

24 Claims, 21 Drawing Figures

NOTE: FIGS. 3 4,5 SHOW START-UP SEQUENCE

DRIVING AGAIN
71
28

REBOUNDING TO UP POSITION

DRIVING
44
71
28

BYPASS FLOW INJECTION
52

UP POSITION

QUIET BOUNCER DRIVER THRUSTER METHOD WITH PRESSURIZED AIR CHAMBER ENCIRCLING MASSIVE BOUNCING PISTON

BACKGROUND OF THE INVENTION

This invention relates to quiet bouncer driver method and apparatus in which a massive piston weight is bounced upon a cushion of compressed gas trapped between the piston weight and a bottom assembly, whereby physical contact between the piston weight and bottom assembly is avoided. More particularly, this invention relates to such pile driver method and apparatus wherein the feeding of compressed gas into the bounce chamber between the piston weight and the bottom assembly is automatically controlled by movement of the piston weight.

Conventional pile drivers of the diesel or steam type use a falling weight or hammer to strike down upon an anvil surface to transmit a blow to a pile. The forces on the anvil resulting from such a noisy, striking type blow become destructive when the energy levels needed to drive a pile become high. In my U.S. Pat. No. 3,714,789, entitled "Automatically Self-Regulating Variable Stroke Variable Rate and Quiet Operating Pile Driver Method and System", I describe a pile driver that overcomes the above and other disadvantages inherent in the conventional steam type or diesel type pile drivers, and this new type of pile driver, which is quiet operating may be called a "bouncer"pile driver; it has a massive piston weight that is advantageously bounced upon a cushion of pressurized gas during operation.

Such a quiet-operating "bouncer" pile driver is also described in U.S. Pat. Nos. 3,788,402 and 3,721,095 in my name as inventor. In the latter patent, there are described advantageous methods and systems for determining the magnitude of the driving forces being exerted on the pile during each powerful bouncing stroke and for controlling the force of the pile driving thrusts as may be desired to enhance the pile-driving operation. The reader may wish to review these patents as background information about the relatively new technology of quiet-operating bouncer pile drivers.

In the bouncer pile driver described in the above-mentioned patents, pressurized gas stored in a bottom assembly is valved into a bounce chamber located between the piston weight and the bottom assembly. This valving occurs during each bounce cycle when the descending piston weight contacts against a plunger head of a valve protruding upwardly from the top of the bottom assembly. Such contacting engagement between the moving piston weight and the initially stationary plunger head of the valve causes rapid acceleration of the valve with consequent stressing of the valve parts.

SUMMARY

An object of the present invention is to provide a quiet pressurized gas bouncer type of pile driver in which the piston weight does not come into contacting engagement with a valve mechanism during the pile driving operation.

A further object of this invention is to provide a quiet-operating bouncer pile driver which is fully automatic, the only requirement for smooth operation being the feeding in of pressurized gas through an input.

A further object of the invention is to provide a quiet bouncer pile driver which is easily assembled and which is extremely durable for continuous use over long periods of time.

Among the advantages of the pile driving method and apparatus of the present invention are those resulting from the fact the intermediate portion of the massive piston weight has a narrowed waist spaced inwardly from the cylinder wall thereby providing an annular pressurized gas storage chamber encircling and travelling with the bouncing piston weight. The pressurized gas is continuously fed through an input into this travelling annular chamber to be accumulated therein. The reciprocating movement of this annular chamber relative to ports in the cylinder automatically produces the desired valving action during each bouncing stroke.

In accordance with the invention in one of its aspects, a pile driver has a cylinder with a massive piston weight movable up and down within the cylinder, and a bottom assembly is associated with the cylinder below the piston weight and is adapted to be coupled in thrust-transmitting relationship to a pile to be driven, the piston weight and bottom assembly defining a pressurized gas bounce chamber within the cylinder between the piston weight and the bottom assembly; and an annular pressurized gas storage chamber is defined between the cylinder wall and a narrowed waist of the piston, the waist being located between upper and lower portions of the piston which are in a gas-sealing, sliding engagement with the cylinder wall. An input continuously feeds pressurized gas into the annular storage chamber, and gas bypass means are associated with the cylinder wall for bypassing pressurized gas from the storage chamber past the lower portion of the piston for suddenly injecting such pressurized gas into the bounce chamber as the piston weight moves downwardly through a predetermined range toward the bottom assembly for trapping and further compressing the trapped gas with great pressure multiplication between the descending piston weight and the bottom assembly, thereby providing a powerful driving thrust to the pile being driven while bouncing the piston weight upwardly. Means are also provided for later releasing gas from beneath the piston weight after that gas has expanded during upward movement of the piston weight.

Thus, as the piston weight descends toward a bottom assembly, it passes through the predetermined range, and pressurized gas previously stored in the annular storage chamber suddenly flows through the bypass means and is injected into the bounce chamber. The pressurized gas in the bounce chamber becomes further compressed below the descending piston weight and provides a high pressure cushion in the bounce chamber for exerting a powerful downward thrust on the bottom assembly for driving a pile while bouncing the piston weight upwardly for repeating the cycle.

In accordance with the invention in another of its aspects, the bypass means comprises a vertical gas feed shroud or bypass chamber located outside of the cylinder and first and second vertically spaced sets of gas feed ports extend through the cylinder wall, normally being in fluid communication with both the cylinder and the outside bypass chamber. The vertical distance between two sets of gas feed ports is greater than the height of the lower portion of the piston which is bypassed by the sudden gas flow.

In accordance with another aspect of the invention, the expanded gas begins to be exhausted as the piston weight nears the top of its stroke. The gas is exhausted through a normally open valve, which valve was previously closed by pressurized gas suddenly passing through the bypass means during downward movement of the piston weight. Specifically, the valve is a ring completely encircling the cylinder wall, and that ring valve is normally biased away from a series of gas outlet ports.

In accordance with a further aspect of the invention, the ring valve during operation is biased away from the ports by a plurality of opening springs. Prior to start-up, the ring valve is biased toward its closed position by a plurality of closing springs which are stronger than the opening springs, and dominate over the opening springs. During start-up, the pressurized gas actuates plungers which remove the closing spring force from the ring valve. The ring valve remains closed by the pressure of gas flowing from the storage chamber through the bypass means to the area between the piston weight and the bottom assembly to raise the massive piston weight in the cylinder.

Advantageously, the ring valve and its seat may include arcuate slots for augmenting the flow capacity.

As the piston weight is ascending, additional pressurized gas bypasses from the annular storage chamber into the cylinder beneath the piston weight, and the expansion of the gas in the cylinder beneath the piston weight aids in propelling the piston weight up to a relatively high position within the cylinder. The ascending piston weight allows the gas in the cylinder to expand until the pressure within the cylinder beneath the piston has dropped approximately to atmospheric pressure thereby allowing the exhaust valve automatically to open. At the time when the exhaust valve opens, the piston weight is near the top of its stroke and it begins falling again while the gas escapes through the open exhaust valve from the cylinder below the descending piston. Thus, this piston weight is now again falling toward the bottom assembly, and the cycle repeats. The massive piston weight is quiet in operation for it is bouncing upon compressed gas. A muffler associated with the exhaust valve quiets the exhaust gas flow.

There are radial grooves in the lower surface of at least the lowest piston ring for accommodating gas flow into the region below the piston weight for raising the piston weight during start-up. During operation, the specially grooved piston ring(s) do not leak, because it is the upper surface of each ring which provides the sealing action during normal operation. The grooves also help to expand the ring as gas pressure builds up in the bounce chamber, thereby augmenting the piston ring sealing action.

This quiet bouncer pile driver is easily assembled or disassembled. The bypass shroud, muffler and valve assembly are axially slidable as a pre-assembled unit into position surrounding the lower end of the cylinder wall, and three seals which encircle the cylinder wall conveniently engage upon raised areas of the cylinder wall for separately sealing the bypass chamber and the muffler.

As used herein, the term "pressurized gas" is intended to include compressed air and steam, because these are the two pressurized gases which may practically be used with this quiet, bouncer pile driver. My preference is to utilize compressed air; however, steam may be used, if desired by the operator, where it is available at the appropriate pressure.

BRIEF DESCRIPTION OF THE DRAWINGS

The foregoing and other objects, features and advantages of the invention will become more fully understood from a consideration of the following more particular description of a preferred embodiment of the invention, as illustrated in the accompanying drawings in which like reference characters refer to like parts throughout the different views. The drawings are not necessarily to scale, emphasis instead being placed upon illustrating the principles of the invention.

FIG. 3 is a partial elevational sectional view of the piston weight initially resting on the bottom assembly within the cylinder, as start-up of the pile driver is initiated with the exhaust valve being closed;

FIG. 4 is a view similar to FIG. 3 but with the piston weight being raised by pressurized gas and the exhaust valve being held closed by the pressurized gas;

FIG. 5 is a view similar to FIGS. 3 and 4 but with the piston weight having been thrown up to a much higher position by the sudden introduction of additional pressurized gas, as shown by the flow arrows in FIG. 4;

FIG. 6 is a cross-sectional view of a lower portion of the pile driver with the piston weight near its uppermost position and pressurized gas being exhausted through the now open exhaust valve;

FIG. 12 is a side view, partially broken away, of the pile driver with the piston weight near its uppermost position and with pressurized gas being fed into the annular storage chamber;

FIG. 13 is a view similar to FIG. 12 with the piston weight falling and pressurized gas still being fed into the annular storage chamber. The pressurized gas is suddenly allowed to bypass the lower portion of the piston weight to be injected into the cylinder below the falling piston weight;

FIG. 14 is a view similar to FIGS. 12 and 13 showing the pile-driving thrust being generated. The piston weight is near the bottom of its stroke. It is bouncing upon the trapped gas thereby achieving a large multiplication in gas pressure and generating a powerful pile-driving thrust. The pressurized gas continues to be fed into the annular storage chamber;

FIG. 15 is a view similar to FIGS. 12–14 showing the piston weight after it has bounced back upwardly while pressurized gas continues to be fed into the annular storage chamber. Also, FIG. 15 shows that the pile driver as a whole has been lowered so as to follow down with the driven pile;

FIG. 16 is a view similar to FIG. 14 showing the pile-driving thrust being generated in the next cycle of operation and pressurized gas continues to be fed into the annular storage chamber;

DETAILED DESCRIPTION OF PREFERRED EMBODIMENT

Figure 1:
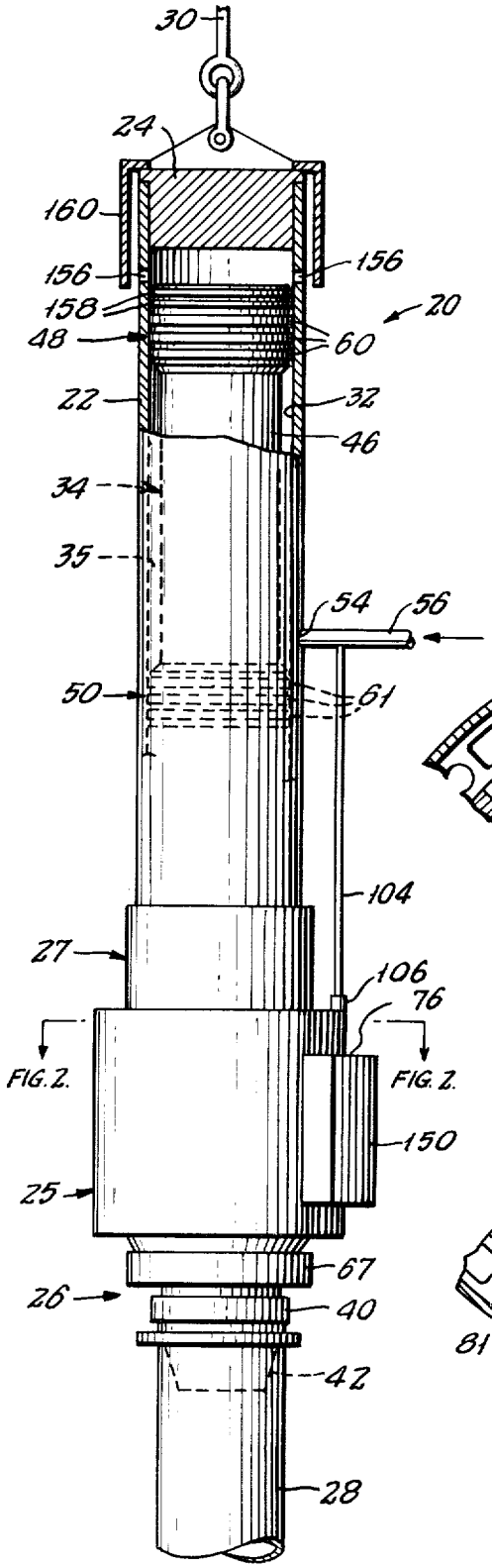
FIG. 1 is a side elevational view of a pile driver embodying the present invention wih an annular gas storage chamber encircling and travelling with the movable piston weight.

As shown in FIG. 1, the pile driver 20 is comprised of a cylindrical housing 22 having a head plug 24 at the top and having adapter and coupling means 26 at the bottom for providing the desired engagement with the pile 28 being driven. The pile driver 20 is suspended by means of a support cable 30 secured to a shackle or eye attached to the head plug 24 in an appropriate manner. Also a pair of parallel leads (not shown) may be included for guiding the pile driver as it moves downwardly with the driven pile. Such leads are conventional in the industry. They are a pair of spaced parallel vertical guide rails which straddle the pile driver and are rigidly fastened to the chassis of a supporting vehicle. Surrounding the lower end of the pile driver is a muffler 25 for muffling the exhausting of the expanded gas, and positioned above this muffler is a bypass shroud 27 for defining a bypass chamber as will be explained later.

Shown being driven into the earth is a pipe pile 28; however, this is illustrative only, —it being understood that a pile driver embodying the present invention can be used to advantage in the driving of any type of drivable pile, such as H-beam piles, sheet piles, timber piles, and so forth.

The cylinder wall 22 is steel and surrounds a cylinder 32 containing a massive steel piston weight generally indicated at 34. The piston weight 34 is narrowed along its intermediate portion for defining an annular storage chamber 35 which encircles the piston weight and travels with the piston weight.

Figures 6, 7, 8:
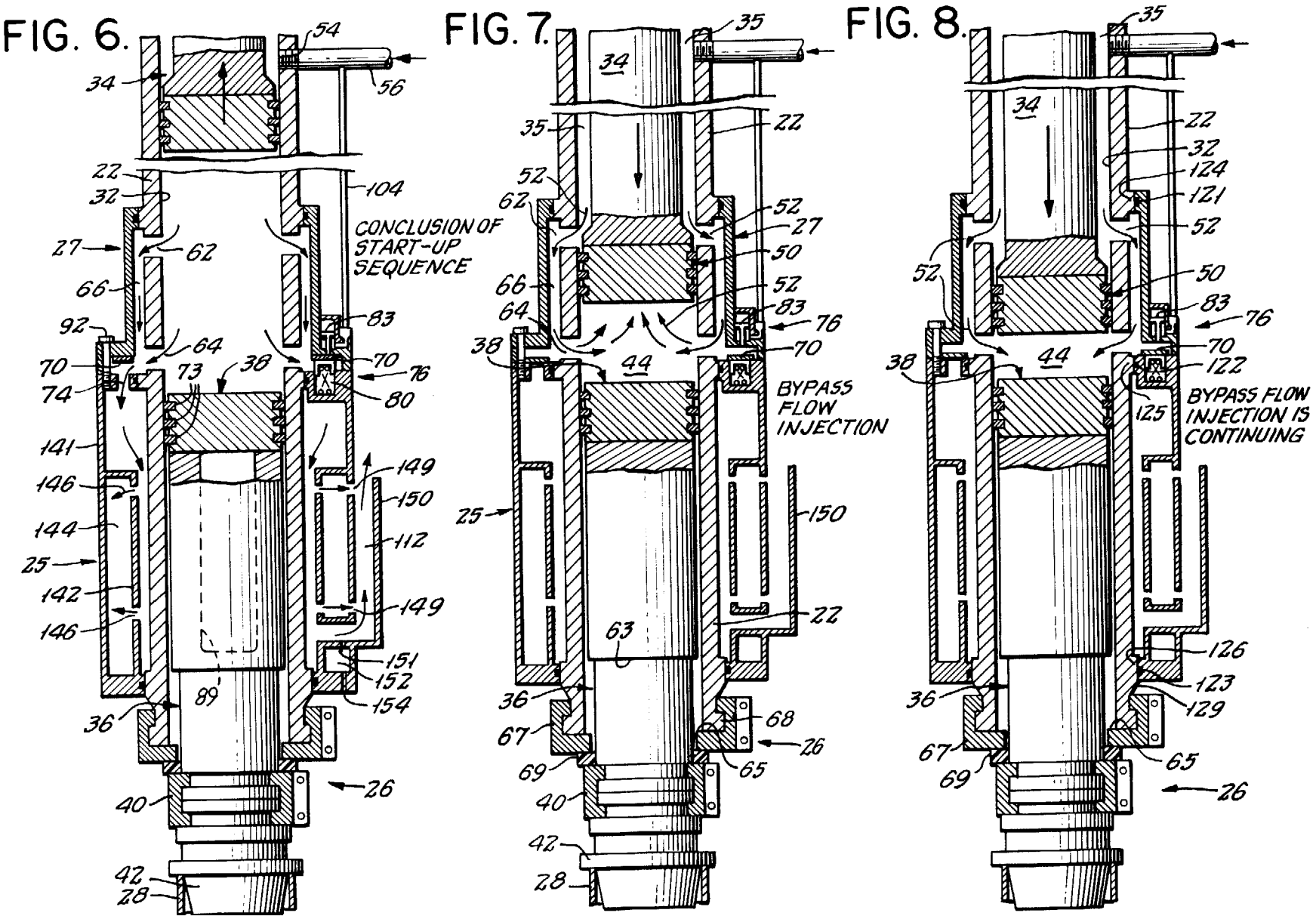
FIG. 7 is a view similar to FIG. 6 but with the piston weight moving downwardly toward the bottom assembly and with pressurized gas suddenly being bypassed from the annular gas storage chamber and being suddenly injected into the bounce chamber, the exhaust valve becoming closed by the sudden downward rush of pressurized gas through the bypass chamber.
FIG. 8 is a view similar to FIG. 7 but with the piston weight shown further down in its downward stroke, just before the instant when the pressurized gas bypass is closed.

At the lower end of the cylinder wall 22, as shown in FIG. 6, there is a cylinder bottom assembly, generally indicated at 36, effectively closing off the lower end of the cylinder wall 22. The cylinder bottom assembly 36 includes a second or bottom piston 38 coupled to the pile 28 through a pile-driving adapter 42 secured to the second piston 38 by a detachable coupling 40. The adapter 42 is shaped so as to engage the upper end of the particular pile being driven as known in the pile-driving art, and this adapter is removed and replaced with a different adapter when a differently configured pile is being driven.

Within the cylinder wall 22, between the lower end of the massive piston weight 34 and the cylinder bottom assembly 36, is a bounce chamber 44 (FIGS. 7 and 8). Pressurized gas injection means to be described are provided for suddenly injecting pressurized gas into the bounce chamber 44 beneath the descending piston weight 34. It is desired that the pressurized gas be locally stored for sudden injection of a large quantity of the pressurized gas into the bounce chamber at the proper instant. To this end, as shown in FIG. 1, the piston weight 34 has an elongated narrowed waist 46 between its upper and lower end portions 48 and 50. The space 35 between this narrowed waist 46 and cylinder wall 22 is an annular storage chamber 35 (as referred to above) for locally accumulating and containing pressurized gas. Pressurized gas is continuously fed into this annular storage chamber 35 through an input port 54 in the cylinder wall 22. The pressurized gas is supplied through a pressurized gas feed line 56 from a suitable supply. Thus, as the piston weight reciprocates up and down with each cycle of operation, a supply of pressurized gas is carried with the moving piston in the annular storage chamber 35.

As discussed in the introduction, the most suitable pressurized gas to be used for the pile driver 20 is compressed air supplied from a compressor. There are modern compressors which are quiet in operation, and it is preferred that a quiet compressor be employed for supplying this quiet-operating bouncer pile driver 20. In this embodiment, normal operation calls for the pressure in the supply line 56 to be approximately 100 pounds per square inch (psi); however, higher or lower supply pressures may be used, depending upon the requirements of the job.

In order to retain the pressurized gas within the annular storage chamber 35, three piston rings 60 and 61, respectively, are provided in the upper and lower end portions 48 and 50 of the piston weight.

A bypass shroud 27 is provided encircling the cylinder wall 22, and when the piston weight 34 falls to within a predetermined range of the bottom piston 38 pressurized gas suddenly flows in bypass relationship past the lower end portion 50 and is thereby injected into the bounce chamber 44 beneath the descending piston weight to provide a pressurized gas cushion between the descending piston weight 34 and the bottom assembly for driving the pile downwardly without impact between the piston weight and the bottom assembly.

Figure 2:
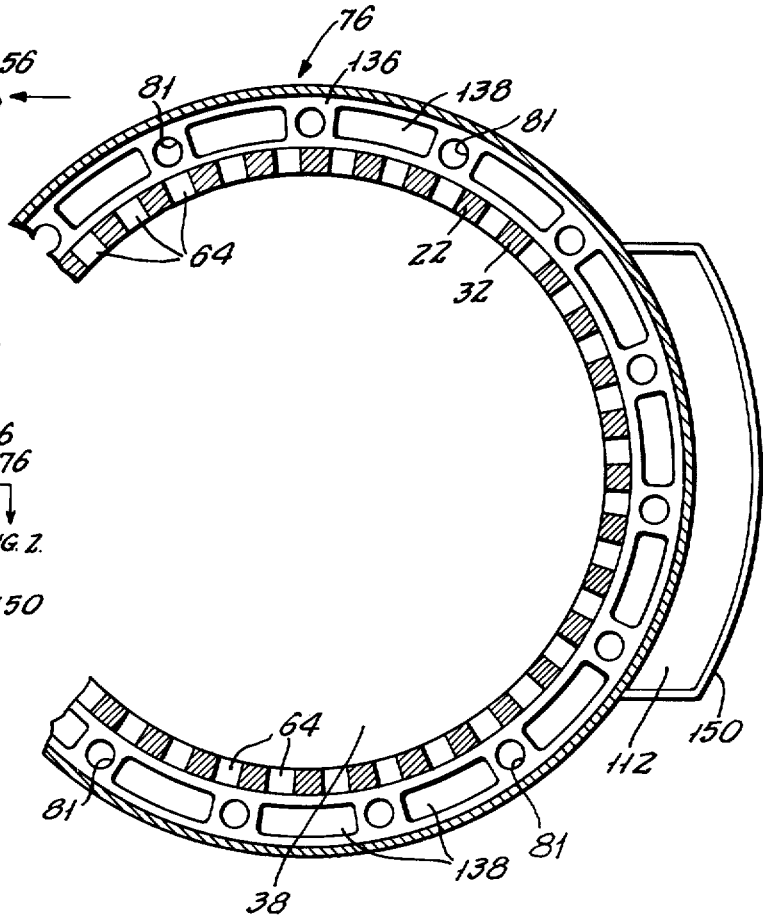
FIG. 2 is a cross-sectional view of the pile driver of FIG. 1 taken along lines 2—2 and showing gas feed ports into a bounce chamber surrounded by a valve assembly having exhaust ports.
Figure 17:
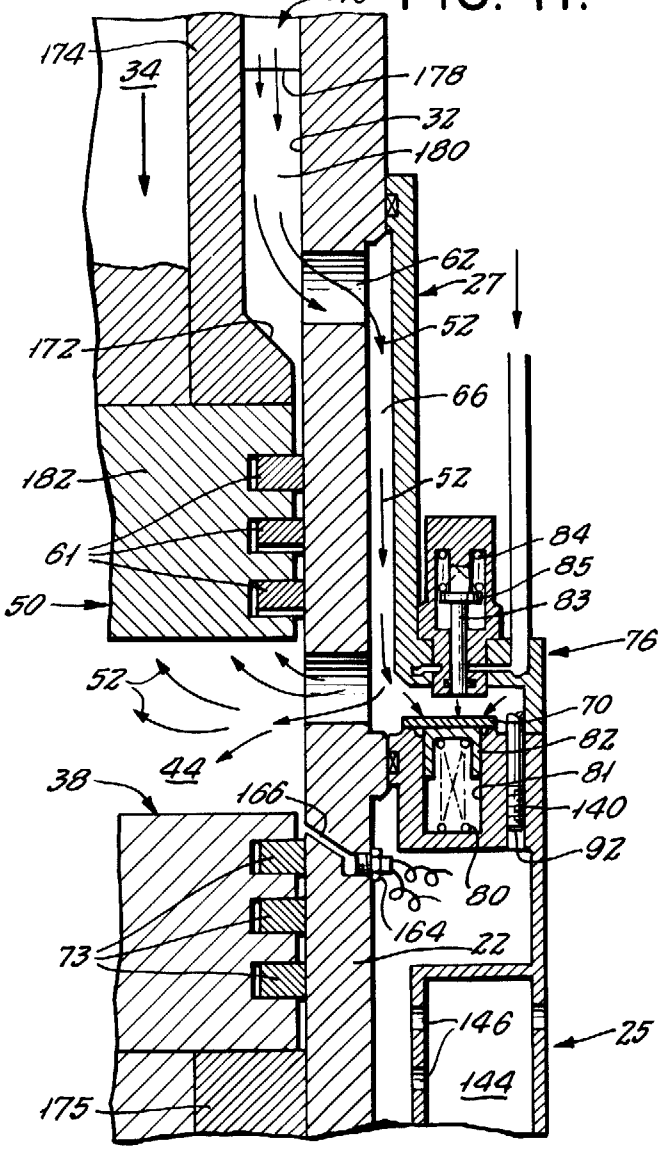
FIG. 17 illustrates how the sudden rush of pressurized gas through the bypass chamber during descent of the piston causes the ring valve to be pushed down to its closed position.

The action of the bypass means, as shown in FIGS. 7 and 17, includes two sets of gas-feed ports 62 and 64 which are vertically spaced in the cylinder wall and are located near the bottom piston 38. Each set of ports 62 and 64 includes a row of circumferentially spaced circular ports spaced around the cylinder 32 and passing through the cylinder wall 22. FIG. 2 shows the lower set of these ports 64. The sets of ports 62 and 64 are in communication with both the cylinder 32 and an annular gas-feed passage or chamber 66 defined by the shroud 27 encircling the cylinder wall 22.

As shown in FIGS. 7 and 17, the height of the bottom piston end portion 50 is considerably less than the vertical distance between the two sets of gas-feed ports 62 and 64. Thus, when the piston weight 34 falls to a level within a predetermined range as shown in FIGS. 7 and 17, pressurized gas suddenly flows, as shown by the flow arrows 52, from the annular pressurized gas storage chamber 35 surrounding the piston weight 34 out through the gas-feed ports 62, down through the bypass passage 66 and in through gas-feed ports 64 into the bounce chamber 44 above the bottom piston 38. The sudden rush of pressurized gas 52 flowing down through the bypass passage 66 causes the exhaust valve means 70 to become closed.

During this injection of pressurized gas into the bounce chamber 44, the piston weight 34 continues to fall downwardly as shown in FIG. 8 until the lowest of the three piston rings 61 in the lower end portion 50 comes near to the lower set of gas feed ports 64. At this instant of time as shown in FIG. 8, the bypass flow 52 of pressurized gas is about to be shut off by continuing descent of the piston weight.

Figure 9:
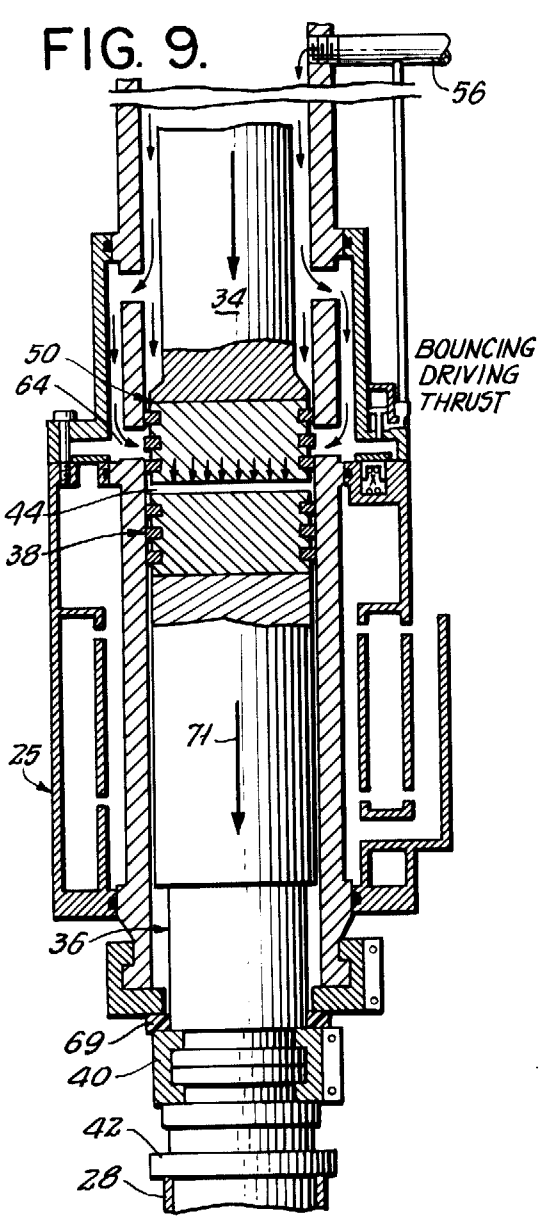
FIG. 9 is a sectional view similar to FIGS. 6 through 8, but with the piston weight having descended below the gas bypass, thereby trapping the gas in the bounce chamber and compressing the gas with a great pressure multiplication for powerfully driving the pile downwardly while also forcefully bouncing the piston weight upwardly.
Figures 12, 13, 14, 15, 16:
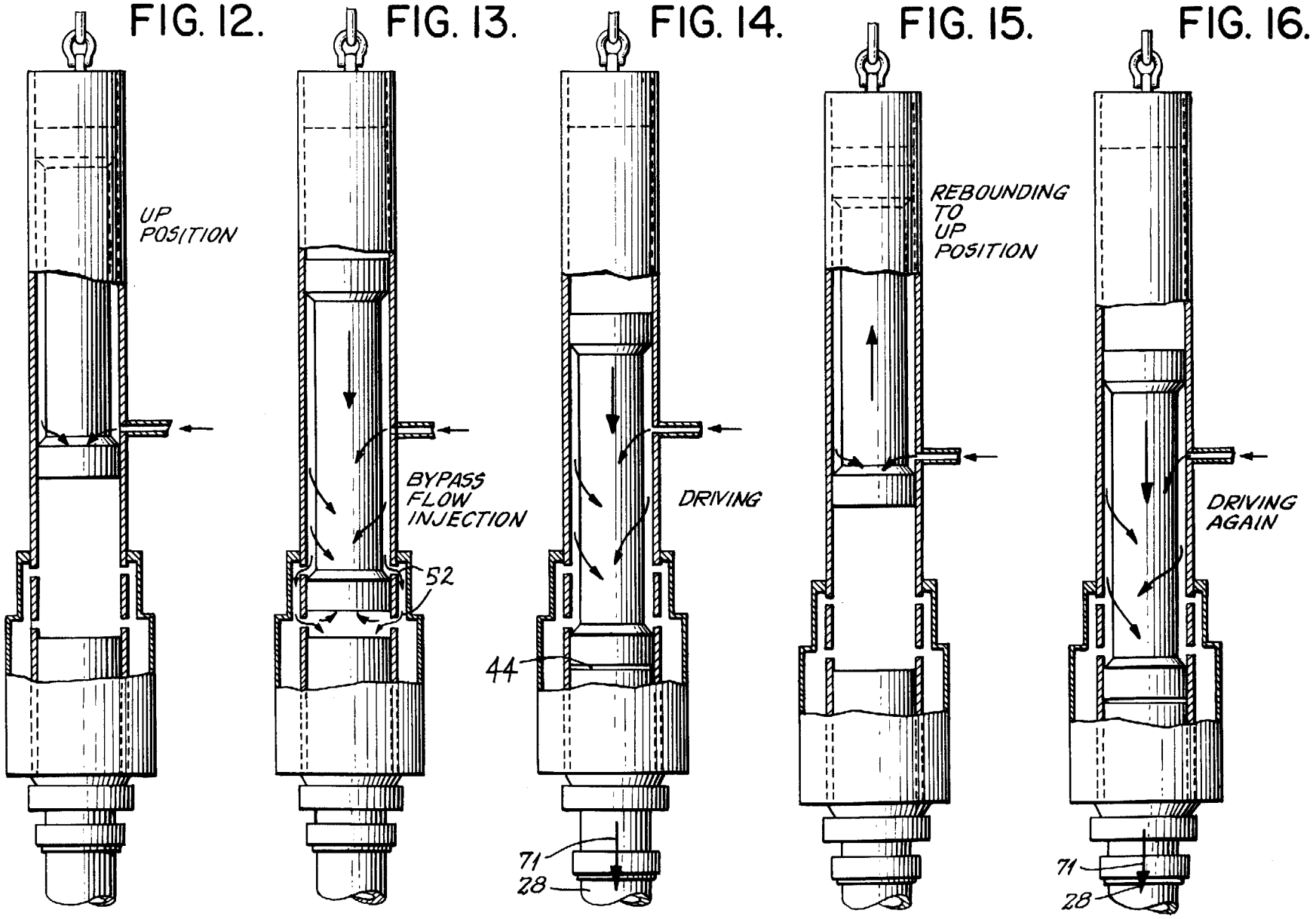
FIGS. 12 through 16 are intended to be considered in sequence. They illustrate the advantageous manner in which the annular air storage chamber which encircles the waist of the piston weight is operating while it is travelling with the piston weight and while it is always in communication with the input of pressurized gas.

A moment later, as shown in FIG. 9, the lower end 50 of the piston weight has moved down into a position where the piston rings 61 block (shut off) the lower set of gas-feed ports 64. Thus, the pressurized gas is now suddenly trapped in the bounce chamber 44, and is further compressed as a cushion, with great pressure multiplication between the falling piston weight and the bottom assembly acting to drive the bottom assembly downwardly for driving a pile. The rapid increase in pressure of the trapped gas in the bounce chamber 44 now bounces the massive piston weight 34 upwardly in a powerful bouncing action while producing a powerful downward driving thrust (arrow 71) on the bottom assembly 36, and this powerful thrust 71 is thereby applied to the pile 28 for driving it down.

In a test using a large size pile 28 which had already been driven down to a very rigid strata of the earth and using only approximately 100 psi of compressed air in the supply line 56, the pressure multiplication occurring in the bounce chamber 44, as shown in FIG. 9, was approximately 14 to 1. In other words, 1,400 psi of pressure were being applied to each square inch of the top surface of the bottom piston 38.

In this example, in which the diameter of the cylinder 32 (and also the diameter of the bounce chamber 44 at the lower end of this cylinder) is 23.5 inches, the piston weight 34 and the bottom piston 38 each have an effective cross-sectional area of approximately 433 square inches.

(1) Driving Thrust = Piston Area X Maximum Pressure in Bounce Chamber (2) Driving Thrust = 433 × 1,400 = 606,200 Pounds It is to be understood that by using a longer and larger diameter piston weight 34 with a longer stroke, and a larger diameter cylinder and bounce chamber, then considerably greater driving thrusts can be provided, if desired. It is believed that this illustrative bouncer pile driver 20, as shown in this example, is sufficiently large and powerful for a wide variety of useful pile-driving applications.

As shown, for example in FIG. 7, the bottom assembly 36 has a stop surface 63 and is retained in the lower end of the cylindrical wall 22 by a stop surface 65 provided by a ring clamp 67 which engages over an outwardly projecting lip 68 encircling the lower end of this wall 22. Removal of this ring clamp 67 allows the bottom assembly 36 to be conveniently slid down out of the cylindrical wall 22 for inspection and maintenance. As shown at 69 (FIG. 7), a ring pad of tough resilient material, for example such as polyurethane, encircles the bottom assembly 36 between the ring clamp 67 and the coupling 40. Thus, when the cable 30 (FIG. 1) is slack, the pile driver 20 rests upon the pile adapter 42 with the weight of the pile driver being borne by the ring clamp 67 resting down upon the pad 69.

In order to lighten the bottom assembly 36, it may be made with a hollow interior 89 (FIG. 6) encircled by a relatively thick strong cylindrical wall. Then the thick disc holding the bottom piston rings 73 (FIG. 6) and forming the head of the piston 38 covers over the hollow interior of the bottom assembly. This head of the piston 38 is secured to the remainder of the bottom assembly 36 by a ring of strong machine screws (not shown).

The actual stroke of the bouncing piston weight 34 may vary somewhat depending upon the impedance being offered by the pile being driven and the requirements of the job. The maximum available stroke is not always utilized. The more rigid the driven pile (i.e., the higher its impedance), then the higher tends to bounce the piston weight 34 for any given pressure of the pressurized gas being supplied through the supply line 56.

In this example, the maximum stroke of the piston weight 34 is approximately 66 inches. The piston weight 34 has a weight of approximately 11,000 pounds.

Figure 11:
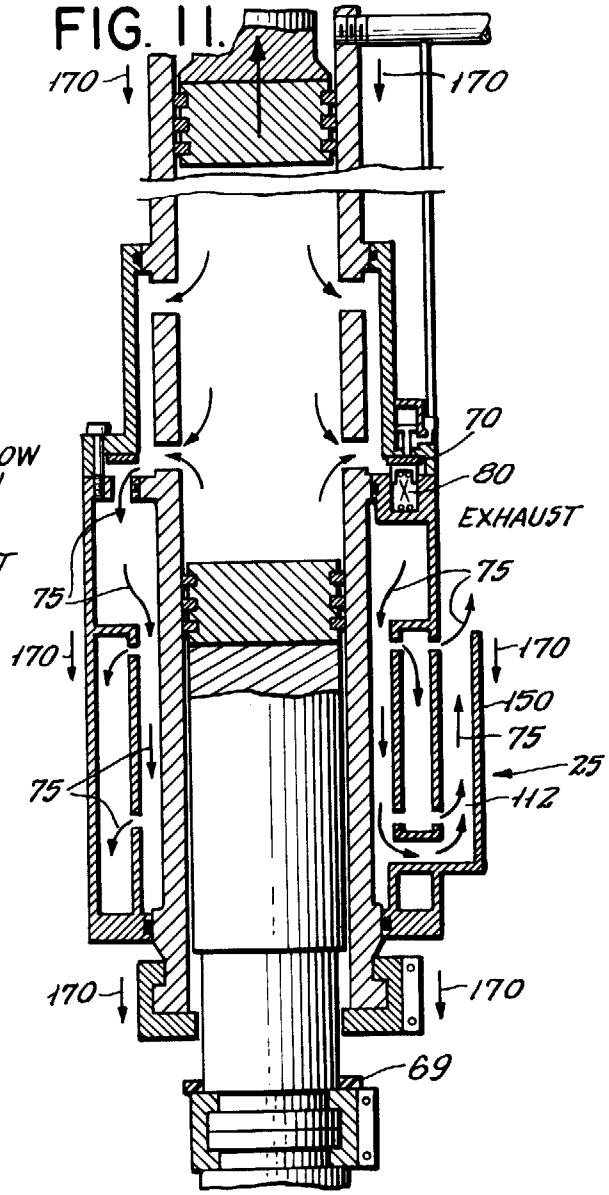
FIG. 11 is a view similar to FIGS. 6 through 10 with the ascending piston continuing upwardly approximately to the same position as shown in FIG. 6, and the expanding gas is now being exhausted through the now open exhaust valve, thus completing a cycle of operation.
Figure 10:
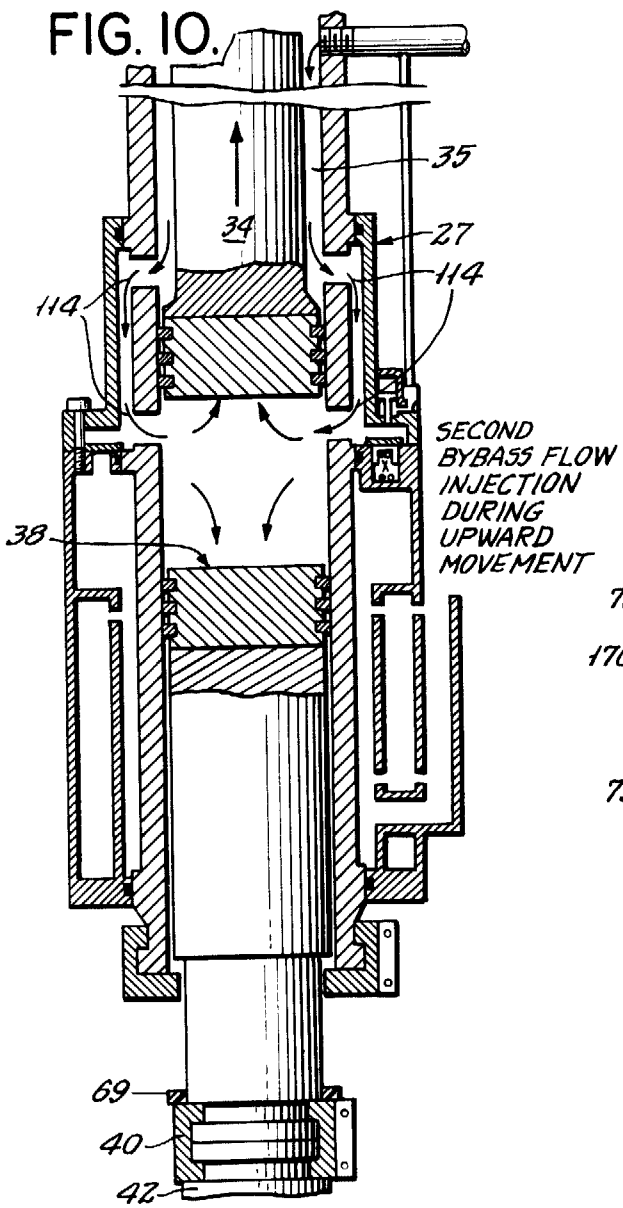
FIG. 10 is a view similar to FIGS. 6 through 9 and showing the piston weight bouncing upwardly and the pressurized gas again bypassing the lower portion of the piston for suddenly entering the cylinder below the ascending piston for propelling it upwardly.

As this powerful driving thrust 71 is being delivered, the piston weight is bounced upwardly by the very high pressure in the trapped and compressed gas cushion between the piston weight 34 and the bottom piston 38. Accordingly, the piston weight 34 bounces upwardly as shown in FIGS. 10 and 11. The expanded gas is then exhausted through the now open exhaust valve 70 and the exhaust muffler 25. The details of the above components will be described in more detail later. The expanded gas is allowed to exhaust as the ascending piston weight nears the top of its stroke as shown in FIG. 11 by the arrows 75. Thus, the piston weight is free to fall again to repeat the cycle of powerful, bouncing, driving action.

FIG. 2 is a cross-sectional view of the pile driver showing the lower ring of gas feed ports 64 of the gas bypass means. The ring valve 70 is omitted from FIG. 2 to show the top of the muffler, as will be explained later.

As shown most clearly in FIG. 17, the ring valve 70 is normally biased toward its open position by a plurality of opening (or lifter) springs 80 individually mounted in sockets 81 in a valve assembly 76 encircling the cylindrical wall 22 at the lower end of the bypass shroud 27 and at the upper end of the muffler 25.

In this pile driver 20, there are fifteen of these lifter springs 80 and a cylindrical spring cap 82 fits over the top of each spring. These spring caps 82 can slide freely up and down within their respective sockets 81 for lifting the ring valve.

Positioned above the ring valve 70 are a plurality of vertically movable valve-closing plungers 83. Each of these plungers 83 is positioned in alignment with a respective lifter spring and cap 80, 82, and so there are fifteen such plungers 83.

As shown in FIG. 2, spring sockets 81 are located between the respective arcuate exhaust ports 138 in the annular top member 136 of the muffler, so that there are 15 of these ports. It is to be understood that a greater or lesser number than 15 of these respective components can be employed, but this arrangement, as described, is the best mode I know for putting this invention into practice.

Figures 3, 4, 5:
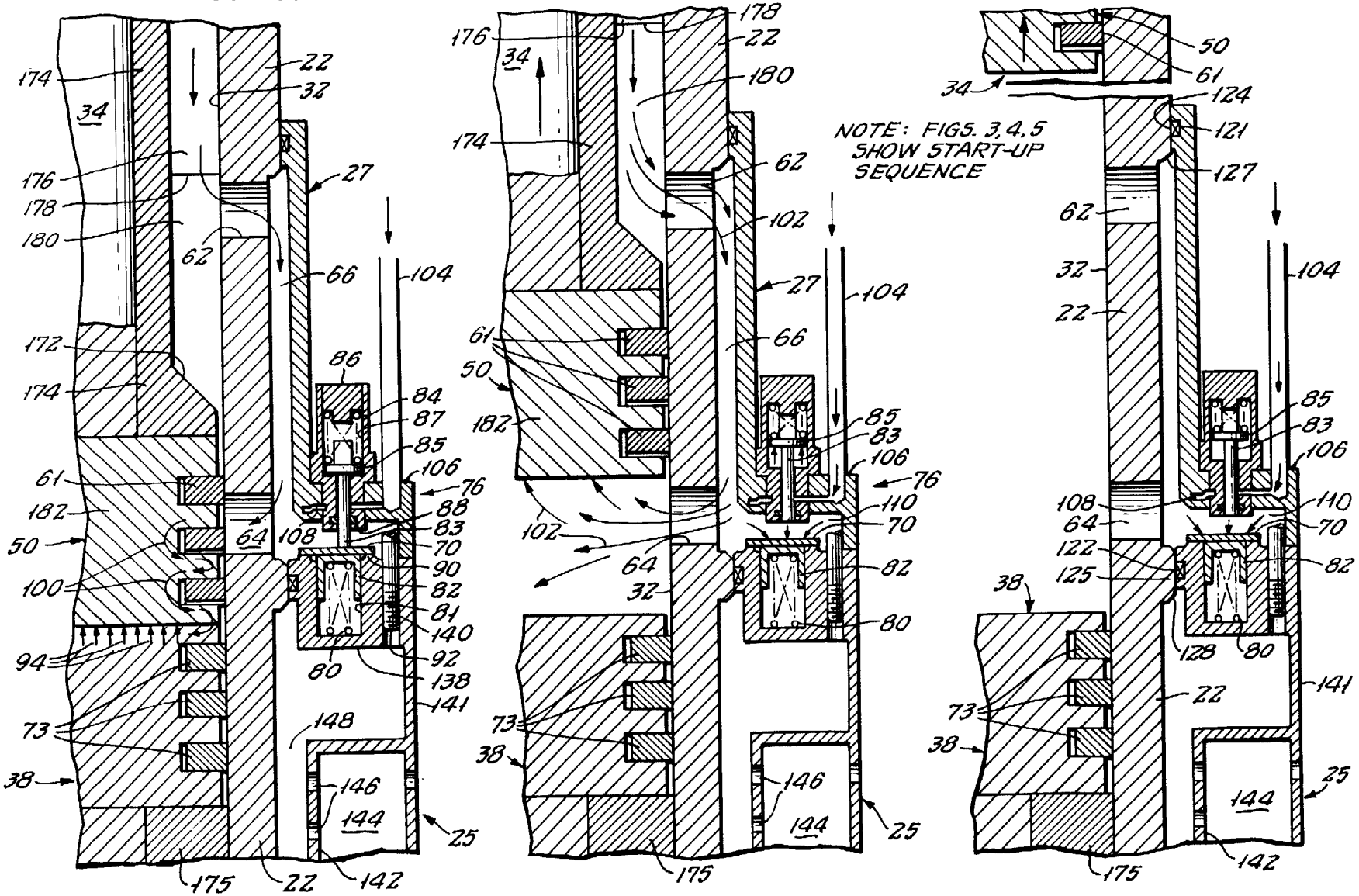
FIGS. 3 through 6 are intended to be considered in sequence. They illustrate the advantageous start-up action.

As shown in FIG. 3, prior to start, each plunger 83 is pushed down to its valve-closing position by a closing spring 84 which seats down on a piston shoulder 85 of the plunger 83 and which seats up against a spring retainer 86 located in the top of a small cylinder 87 in the valve assembly 76. These spring retainers 86 (FIG. 3) are removable from their respective cylinders 87 for enabling removal and inspection or replacement of the plungers 83 and springs 84. These removable spring retainers 86 are not indicated in the other Figures for clarity of illustration.

Each of the closing (or depresser) springs 84 is somewhat stronger than its opposed opening (or lifter) spring 80. Therefore, in the absence of any pressurized gas, the plungers 83 hold the ring valve 70 down in its closed position as shown in FIG. 3.

When pressurized gas is introduced into the bottom of each cylinder 87 beneath the piston shoulder 85 of the respective plunger 83, then the plunger is raised to its upper position, as shown, for example in FIGS. 4, 5 and 17. An O-ring seal 88 (FIG. 3) is in sliding engagement with the shank of each plunger 83 for preventing escape of pressurized gas around the shank.

The valve assembly 76 as a whole can be disassembled by removing a plurality of machine screws 92 (FIG. 6) which are circumferentially spaced around the valve assembly 76. The threaded shank of such machine screw 92 can be seen, for example in FIGS. 3 and 17.

Figure 18:
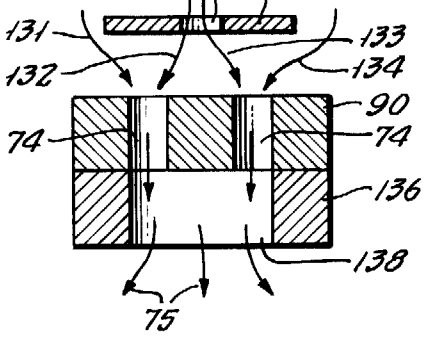
FIG. 18 is an enlarged cross-sectional view of the slotted ring valve raised from its slotted ring seat, thereby allowing the expanded gas to escape through multiple flow paths in parallel.
Figure 19:
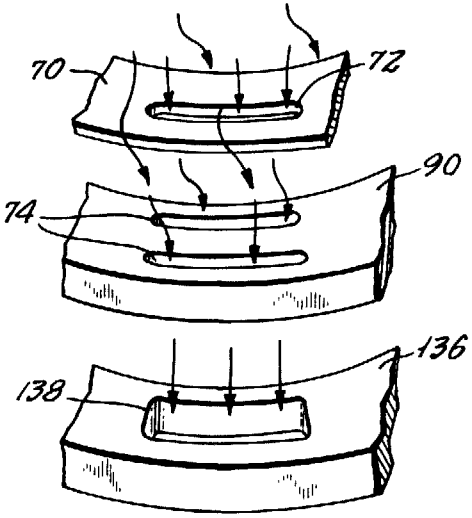
FIG. 19 is a partial exploded perspective view showing portions of the ring valve, the ring seat and the top of the muffler.

The start-up operation of the pile driver 20 can be best understood with reference to FIGS. 3 through 6. As shown in FIG. 3, the piston weight 34 initially rests on the bottom piston 38. The valve-closing plungers 83 are down, and the valve ring 70 is therefore being held closed against its annular seat 90 thereby closing the exhaust ports 74. FIGS. 18 and 19 which show the structure and cooperation of the ring valve 70 and its seat 90, and exhaust ports 72 and 74, will be described in greater detail later.

In order to initiate start-up of the pile driver 20, the pressurized gas is fed through the supply line 56 (FIG. 1). The pressurized gas fills the storage chamber 35 surrounding the piston weight 34 and flows out (FIG. 3) through the upper set of feed ports 62 into the bypass feed passage 66. From the passage 66, and with the valve 70 in its closed position, the gas flows inwardly through the lower set of feed ports 64. At this initial time with the piston weight 34 resting on the bottom piston 38, the lower end 50 of the piston weight 34 is near the lower set of feed ports 64. From these feed ports 64, the pressurized gas leaks down past the two lowest piston rings 61 and enters the region between the lower end 50 of the piston weight 34 and the bottom piston 38, thereby exerting a lifting force on the piston weight 34, as shown by the multiple small arrows 94, thereby lifting the piston weight 34 up from the bottom piston 38.

Gas flow augmentation means may be provided for augmenting the flow of pressurized gas from the lower feed ports 64 into the lifting region 94, comprising a plurality of shallow radial grooves 96 (FIG. 20A) in the lower surfaces of the two lower piston rings 61. The pressurized gas flows radially inwardly, as shown by arrows 100, through the normal operating clearance 98 between the top surface of the piston ring and its groove 99 in the lower end 50 of the piston weight 34. The gas flows downwardly behind the ring and outwardly through the slots 96, thereby passing down around each of the two lower rings 61 in succession, as shown by the flow arrows 100 in FIG. 3.

Such flow augmentation means are not necessary, for the pile driver 20 will start-up without the grooves 96, but not quite as quickly as when they are present.

Thus, during start-up, the entry of pressurized gas exerts a lifting force 94 (FIG. 3) on the piston weight 34 and lifts it up until its lowest piston ring 61 clears the lower set of feed ports 64. Immediately, a surge 102 (FIG. 4) of pressurized gas flows in through the feed ports 64 into the cylinder 32 beneath the piston weight 34. As shown in FIG. 4, this rush 102 of pressurized gas flows from the annular chamber 35 out through feed ports 62 down through bypass chamber 66, and in through the ports 64. This pressurized gas 102 expands and throws the piston weight 34 up, as shown in FIG. 5.

During start-up, pressurized gas from the supply line 56 (FIG. 1) also feeds down through a smaller diameter branch line 104 extending down to a connection 106 in the valve assembly 76. The pressurized gas enters an annular channel 108 (FIGS. 3 and 5) extending around the pile driver and communicating with the lower end of each plunger cylinder 87 above the location of the seal 88. Thus, the pressurized gas lifts each of the plungers 83 to its raised position as shown in FIG. 4. The plungers 83 remain steadily in their up positions during operation, until the pressurized gas supply is shut off, thereby allowing the closing springs 84 to depress the plungers.

Even though the plungers 83 have been lifted away from the ring valve 70, the ring valve is held closed by the pressure of the gas as shown by the multiple small arrows 110 in FIGS. 4 and 5.

Continuing description of the final phases of start-up, it is noted that the piston weight 34 was thrown up as shown in FIG. 5 by the expanding gas. The piston weight 34 coasts upwardly until the pressure within the cylinder 32 approaches atmospheric, at which time the lifter springs 80 raise the ring valve 70 to its open position, allowing exhaust flow to occur as shown in FIG. 6. The gas flows downwardly through the exhaust ports 74 through a labyrinthine path in the muffler 25 (to be described in detail further below) and exits through an exhaust passage 112 (see FIG. 2).

Now that exhausting of the pressurized gas has occurred, the piston weight 34 is free to fall downwardly to start the first cycle of driving operation.

As noted above, FIGS. 7 and 17 show the piston weight 34 falling downwardly toward the bottom assembly 36. As the lower piston portion 50 falls below the upper set of gas feed ports 62, pressurized gas from the annular gas storage chamber 35 passes out through the upper ports 62 down through the bypass passage 66 and back in through the lower ports 64, thereby being suddenly injected into the bounce chamber 44. Simultaneously, as shown most clearly in FIGS. 7 and 17, the sudden downward flow 52 through the bypass passages 66 causes the annular valve plate 70 to be slammed downwardly to close the ports 74 and thereby retain the charge of pressurized gas in the bounce chamber 44. The ring valve 70 is thereafter held closed by gas pressure pressing down on its upper surface until the piston weight 34 has rebounded and ascended up to a position near the top of its stroke. The pressure of the expanding gas beneath the ascending piston weight approaches atmospheric pressure allowing the lifter springs 80 to raise the ring valve 70 to its open position for exhausting the expanded gas.

FIG. 8 shows the piston weight 34 at a point in its fall during each cycle of operation, namely, at the lower end of the range in which the pressurized gas is free to pass from the gas storage chamber 35 into the bounce chamber 44. At this point, the pressure of the gas in the bounce chamber 44 is approaching that existing in the gas storage chamber 35.

FIG. 9 shows that because the gas ports 64 are spaced above the bottom assembly, when the lower piston portion 50 passes those ports during each cycle of operation, the pressurized gas becomes trapped in the bounce chamber 44 between the bottom piston portion 50 and the piston 38 of the bottom assembly 36. With the piston weight still falling, the pressurized gas in the bounce chamber becomes highly compressed. At the maximum compression of the gas in the bounce chamber, the piston is still spaced somewhat above the bottom assembly but drives the bottom assembly downwardly. The maximum force against the piston 38 of the bottom assembly is applied at this point in time as the piston is bouncing upon the highly compressed cushion of gas, as calculated in equations (1) and (2) above.

FIG. 10 shows that as the rebounding piston weight is ascending during each cycle of operation, an injection flow 114 of pressurized gas also occurs into the cylinder beneath the ascending piston weight 34. The pressurized gas is allowed to flow suddenly from the annular chamber 35 out through ports 62, down through bypass passage 66, and in through ports 64. This injected pressurized gas expands and aids in throwing the piston weight upwardly.

In summary, two injections of bypassing pressurized gas occur, one injection flow 52 occurs as shown in FIGS. 7 and 8 during descent of the piston weight prior to bounce. The second injection flow 114 occurs as shown in FIG. 10 during ascent of the piston weight as described in the preceding paragraph.

The manner in which the supply of pressurized gas continues to be fed into the travelling annular chamber 35 is shown in FIGS. 12 through 16, which are intended to be considered together in sequence.

The movement of the whole piston weight 34 through one cycle and into the next is illustrated in FIGS. 12 through 16. In those Figures, it can readily be seen that the pressurized gas feed 56 is always in a gas-flow communicating relationship with the annular gas storage chamber 35 around the narrow waist of the moving piston weight 34. Thus, a local storage of pressurized gas is always maintained, that gas being almost instantaneously injected into the bounce chamber when the lower end portion 50 of the piston weight moves into its position between the upper and lower bypass feed ports 62 and 64 during each down and up stroke.

The ring clamp stop 65, 67 is clamped to the lower end of the cylinder wall 22 in order to prevent the bottom assembly 36 from being dropped or driven down through the bottom of the cylinder in the event that the pile hits soft ground, or the like. Generally, however, the piston stop 63 remains spaced above the lower stop 65 due to the resistance of the ground to driving movement of the pile.

As shown in FIG. 8, the bypass shroud 27, valve assembly 76, and muffler 25 form an integral structure or unit having three O-ring seals 121, 122 and 123 which are pressed against relatively raised circumferential areas 124, 125 and 126 on the outer surface of the cylinder wall 22. In assembly, before the retainer stop 65, 67 is clamped to the lower end of the cylinder wall 22, the whole annular unit (including shroud 27, valve assembly 76, and muffler 25) is positioned below the cylinder wall 22 and slid upwardly into the position shown. Each seal 121, 122 and 123 engages the respective raised exterior surfaces 124, 125 and 126 of the cylinder wall. This assembly is secured in position by brackets (not shown) attached to this assembly and to the pile driver, and then the stop 65, 67 is clamped on the pile driver.

It is to be noted (FIGS. 5 and 8) that there are ramp-like sloping surfaces 127, 128 and 129 adjacent to the respective raised sealing surfaces 124, 125 and 126. These ramp-like surfaces 127, 128 (FIG. 5) and 129 (FIG. 8) slope outwardly and upwardly for facilitating the upward sliding of the respective O-ring seals into their compressed sealed relationship seated in their respective grooves and engaging on the raised sealing surfaces 124, 125 and 126. Thus, assembly is convenient.

As shown in FIGS. 18 and 19, there are a pair of arcuate slot-shaped exhaust ports 74 in the valve seat 90 operatively associated with each respective arcuate slot-shaped exhaust port 72 in the ring valve. In other words, these pairs of exhaust ports 74 in the valve seat are circumferentially aligned with but radially offset inwardly and outwardly from the respective exhaust ports 72 in the valve. Consequently, when the ring valve 70 is raised from its seat 90, there is large exhaust flow capacity through four parallel paths 13, 132, 133 and 134 (FIG. 18). In effect, the exhaust flow 75 (FIG. 11) branches into the four parallel paths 131–134 (FIGS. 18, 19) when passing through the open valve means 70, 90.

By virtue of the large exhaust flow capacity provided by the four paths 131–134 acting in parallel and acting conjointly with relatively long arcuate ports 72 and 74, a relatively short up and down stroke can be employed for the steel ring valve 70. For example, this short stroke of the exhaust valve 70 in this embodiment is only approximately ⅛th to 3/16ths of an inch. I have found that a short stroke of the steel ring valve 70 is advantageous for minimizing metal fatigue stresses in ring 70 arising from cyclically occurring acceleration forces, thereby greatly extending the operating life of this ring valve.

As shown in FIGS. 18 and 19, the ring valve seat 90 is assembled with an annular frame member 136 forming the top of the muffler 25. This frame member 136 has a plurality of ports 138 therein aligned with the pairs of exhaust ports 74, and these fifteen ports 138 provide entrance for the exhaust flow 75 (FIG. 11) into the muffler 25. The valve seat 90, in effect, forms the bottom of the valve assembly 76 mating with the annular frame member 136 at the top of the muffler 25. When the pile driver 20 is assembled, as shown in FIGS. 1 and 3–17, this valve seat 90 and frame member 136 are immediately adjacent to each other, and so for clarity of illustration, they are not separately cross sectioned in FIGS. 3–17. The machine screws 92 (FIGS. 6 and 3) are screwed into threaded holes in this frame member, as indicated by the threading 140 in FIG. 3.

As shown in FIG. 6, the muffler includes outer and inner concentric cylindrical walls 141 and 142 which are radially spaced for defining an annular muffler chamber 144 between them. The outer muffler wall 141 is welded around its top edge to the periphery of the annular frame member 136 (FIGS. 18 and 19). The inner wall 142 includes numerous small holes 146 throughout its entire area (see also FIG. 3) communicating with the muffler chamber 144. Only a few of these holes 146 are shown for ease of illustration. The inner wall 142 is radially spaced from the main cylinder wall 22 providing an annular passage 148 (FIG. 3), and the exhausting gases 74 flow down through this passage 148 and through the holes 146 into the muffling chamber 144.

Then there are similar small holes 149 (FIG. 6) in the outer muffler wall 141 in the region of the exhaust vent passage 112. The inverted hood 150 (see also FIG. 2) around vent passage 112 serves as a deflector for directing the exhaust flow upwardly.

It will be understood that suitable lubrication means are provided for the cylinder 32, for example as described in my U.S. Pat. No. 3,714,789. The oil used should be a high-temperature-resistant synthetic lubricating oil intended for use in high pressure air compressors for withstanding the momentary high, compressed-gas temperatures which occur in the bounce chamber 44 during each bounce cycle of the massive piston weight 34 due to the large pressure multiplication (compression ratio).

As shown in FIG. 6, a drain hole 151 at the bottom of the exhaust vent 112 leads into an accumulator 152 for accumulating any moisture or oil droplets condensed from the exhaust flow of expansion-cooled gas. A drain port 154 allows removal of this liquid, and the oil can be separated from any water for reuse.

The overall length of the piston weight 34 is approximately 95 inches with a weight of approximately 11,000 pounds, and a maximum stroke of approximately 66 inches. The length of the cylinder 32 below the head plug 24 and above the normal operating position of the bottom piston 38 is sufficient to prevent the piston weight 34 from striking the head plug at maximum stroke. Thus, the length of the cylinder 32 is approximately 161 inches, but may be more.

The length of the annular chamber 35 and the position of the input port 54 must be arranged so that this port always remains communicating with this annular chamber; in other words, neither the upper nor lower piston rings 60, 61 should travel past the port 54.

In order to prevent pressure build up in the top of the cylinder 32, there are multiple small ports 156 (FIG. 1) located a few inches below the bottom of the head plug 24. The reason these ports 156 are located somewhat below the head plug is to provide a region above the level of these ports in which atmospheric air can become trapped to provide an air cushion for preventing impact of the piston weight 34 against the head plug in the event of a high bounce. The three upper piston rings 60 (FIG. 1) are positioned so as to remain at all times below the ports 156 for preventing escape of pressurized gas from the annular chamber 35 through these ports.

In addition to these three rings 60, there are an additional pair of air cushion rings 158 spaced above the rings 60 which will serve to trap an air cushion in the top of the cylinder 32 whenever the air cushion rings 158 happen to rise above the level of the ports 156. A protection hood 160 extends down below the ports 156 for protecting these ports against entry of rain drops or grit into the cylinder 32.

The vertical spacing of the gas feed ports 62 and 64 (center-to-center spacing) is 6.75 inches, while the vertical distance from the bottom of the lower portion 50 of the piston weight 34 to the top of this lower portion is 3.5 inches. Thus, the span between the upper and lower sets of feed ports 62 and 64 is almost twice the effective vertical height of the lower piston portion 50 for providing a significant length of time for the bypass flows 52 and 114 to occur even though the piston weight 34 is travelling down or up relatively fast near the bottom of its stroke.

The lowest portions of the lower feed ports 64 are intended to be approximately two inches above the top of the uppermost bottom piston ring 73 during the start of each bouncing driving thrust, but this distance depends upon the thickness of the pad 69 (FIGS. 6–11). During pile driving operation, the cable 30 (FIG. 1) is slackened by the operator.

Figure 20B:
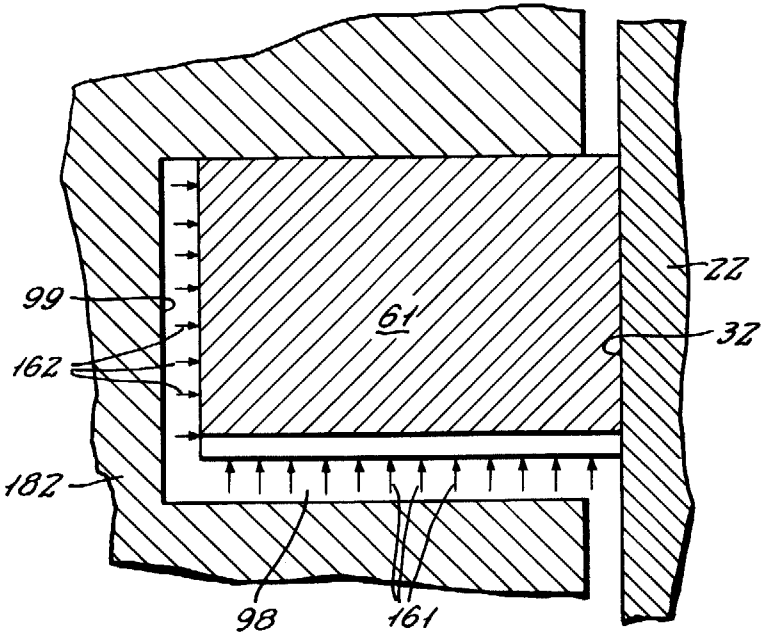
FIGS. 20A and 20B are enlarged partial sectional views illustrating the advantageous action of the radially grooved piston ring(s) during start-up and normal operation, respectively.
Figure 20A:
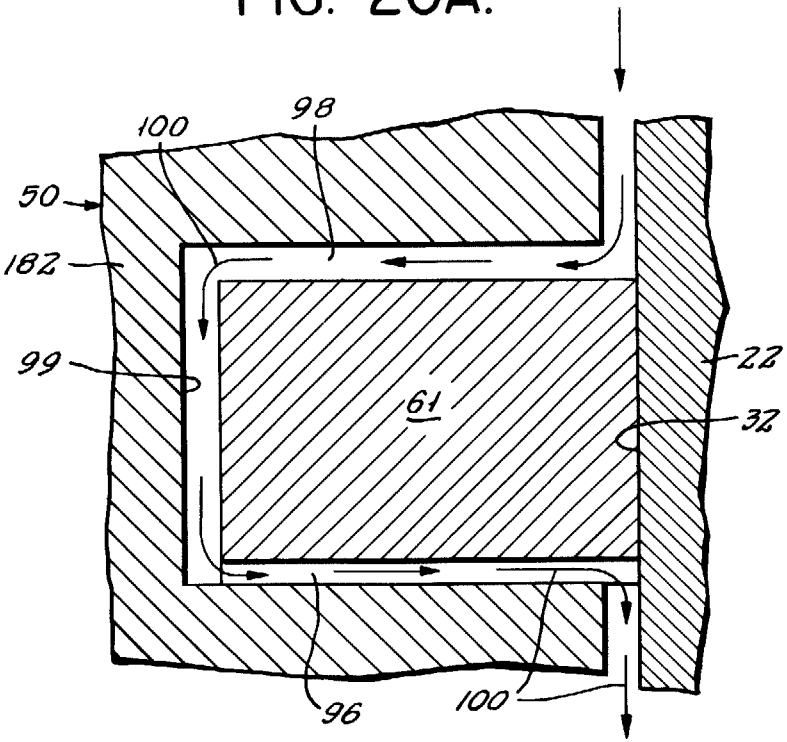

As shown in FIG. 20B, the radial grooves 96 in the lower surface of the lower two piston rings 61 do not allow leakage to occur during normal operation because the pressure of the trapped compressed gas acts upwardly as shown by the arrows 161, thereby pressing the ring against the top of its groove 99. In fact, these radial grooves 96 facilitate entry of trapped compressed gas into the groove 99 behind the ring 61 thereby exerting outward force for expanding the piston rings 61 for holding them snugly against the cylinder wall surface 32 in very effective sealing relationship therewith.

In order to sense the peak pressure occurring in the bounce chamber 44 for conveniently measuring the driving thrust 71 (FIG. 9), a pressure transducer 164 (FIG. 17) may be mounted in a socket in the wall 22 of the cylinder 32 communicating through a passageway 166 with the lower end of the cylinder 32. The use of such a pressure transducer is described in U.S. Pat. No. 3,721,095 and does not form a part of this invention.

In conclusion, a pile driver apparatus which avoids any impact between the reciprocating piston weight 34 and any other element is provided. Valving of the pressurized gas into the bounce chamber below the piston weight is automatically controlled through a bypass during a limited range of movement of the piston. Exhaust of the pressurized gas from the bounce chamber, once the piston has bounced back upwardly is automatically controlled by means of a gas pressure-actuated ring valve. Even the initial lifting of the piston in the cylinder is automatically responsive to the feed of pressurized gas to the pile driver apparatus.

The arrows 170 in FIG. 11 show the pile driver following down the driven pile.

The various components of the pile driver are made of good quality tough steel. The spring caps 82 and plungers 83 (FIG. 3) are hardened steel for resisting wear. The ring valve 70 is fatigue-resistant alloy steel, for example, such as No. 4340 alloy steel heat treated to its highest impact resistance. The piston rings 60, 61, 73 are made of piston ring material suitable for sliding engagement with a steel cylinder wall, for example, such as cast iron or bronze-coated steel, but I have not yet determined my preferred material for these rings.

The upper and lower portions 48 and 50 (FIG. 1) of the piston 34 and the bottom piston 38 each include an encircling bronze sleeve bearing (upper one not shown) adapted to slide against the cylinder surface 32 of the wall 22. These sleeve bearings 174, 175 (FIG. 3) serve to guide the respective ends of the piston weight 34 and piston 38 along the cylinder surface 32, as shown in U.S. Pat. No. 3,714,789.

As shown in FIG. 34 and 17, the lower bearing sleeve 174 is specially configured in order to allow the pressurized gas to flow down past it. There are a plurality of vertically extending circumferentially spaced channels 176 in the exterior surface of this bearing 174 with a vertically extending land 178 located between each of these channels. These lands 178 slide against the cylinder wall 32. In other words, the outer surface of the bearing 174 is scalloped, with alternating lands 178 and grooves 176. The lower ends of all of these grooves 176 communicate with an annular channel 180 formed in the exterior surface of the bearing 174. This annular channel 180 is intended to feed the pressurized gas into the upper set of bypass ports 62 when the channel 180 moves into communication with these ports. This bearing sleeve 174 is held in position on the piston weight 34 by being captured at its lower end by the member 182 which holds the piston rings 61 (FIG. 4) and by being captured at its upper end by an annular shoulder (not shown) on the piston weight 34. The upper sleeve bearing (not shown) is similarly captured.

It is to be understood that lead guides (not shown) are attached to the pile driver 20, as is known in the art. The brackets (not shown) which serve to secure the bypass shroud 27, muffler 25, and valve assembly 76 to the pile driver 20 may be conveniently secured to such lead guides.

To aid in start-up of the pile driver 20, as shown in FIGS. 3–6, it is my preference to include a pneumatic delay in association with the connection 106 (FIGS. 1 and 3). The purpose of this pneumatic delay is to prevent raising of the plungers 83 (FIGS. 3 and 4) before the full gas pressure 110 (FIG. 4) has been applied to the top of the ring valve 70. In this embodiment, as shown, such pneumatic delay means provides a delay of the order of one or two seconds and is an orifice having a diameter of 0.002 of an inch in the connection 106. Thus, the pressurized gas from the line 104 goes through this orifice before it flows toward the annular channel 108.

Such a small diameter orifice operates advantageously. Over a period of time, it might become clogged, and so it should be readily replaceable.

It is important that the effective vertical height of the bottom piston portion 50 be properly proportioned with respect to the vertical span between the upper and lower sets of feed ports 62 and 64 with respect to velocity of the falling piston weight 34, so that the bypass flow 52 (FIGS. 7 and 8) causes the pressure in the bounce chamber 44 to become equalized with the pressure in the annular storage chamber 35 just at the instant when the bottom piston portion 50 blocks (shuts off) the lower ports 64. Otherwise, some of the energy of the falling piston weight 34 is wasted in pushing the excess pressurized gas back up into the annular chamber 35.

The appropriate proportions, as discussed for achieving the optimum bypass flow 52 during piston descent, depend upon the velocity of the falling piston, which in turn depends upon the stroke of the piston weight 34 and also depends upon adequate capacity for ease of exhaust flow 75 (FIG. 11) to allow the piston weight to fall freely, which in turn depends upon the configurations of the exhaust valve assembly 76, and muffler 25. The dimensions as described are the optimum ones I know at this time. It is instructive to connect a recording oscillograph to the pressure transducer 164 (FIG. 17), during trials in order to be aware of the pressure variations occurring in the bounce chamber 44. Then the user will know if an insufficient or excess or optimum amount of bypass flow 52 has occurred before shut off and can lengthen or shorten the bottom piston portions 50 by adding metal to or removing metal from the shoulder 172 (FIGS. 3 and 17) at the lower end of the annular channel 180.

It is to be understood by the reader that I now have only a limited amount of experimental testing results on this new pile driver 20. I know it operates astonishingly well and is very quiet. I have set forth the best mode I now know for putting this invention into practice.

The pile driver 20 is so quiet in actual operation that incidental sounds which are usually masked by the noise of a conventional pile driver become apparent. Thus, during operation, when the cable 30 (FIG. 1) is slackened, the rattle of the shackle or eye at the end of the cable is audible. This rattling sound can be removed by replacing the shackle or eye with a strong, tough nylon sling, or otherwise using elastomeric sound-absorbing material such as rubber or polyurethane resilient padding for the cable connection. Also, the rattle of the lead guides against the leads can be heard. Thus, the lead guides may be padded with elastomeric sound-absorbing material such as rubber or polyurethane. A very quiet pile driver of relatively great power is thereby provided.

While the invention has been particularly shown and described with reference to a preferred embodiment thereof, it will be understood by those skilled in the art that various changes in form and details may be made therein without departing from the spirit and scope of the invention as defined by the appended claims.

I claim:

1. In the method of driving a pile into the earth wherein a heavy piston weight moves down and bounces up in a cylinder by cyclically bouncing upon a cushion of pressurized gas trapped in a region below the descending piston weight and above a bottom assembly which is coupled to the pile being driven and additional pressurized gas is injected into said region during each cycle of operation as the piston weight is descending within the cylinder for replenishing the cushion of pressurized gas to be trapped below the descending piston weight for causing the piston weight to bounce thereon, and expanded gas is released from the cylinder beneath the piston weight into the atmosphere during each cycle of operation as the piston weight is moving upwardly in the cylinder, and wherein the downward thrusts of the bouncing piston weight on the cushion of trapped pressurized gas are utilized for driving the pile, the further invention comprising the steps of:

carrying a supply of pressurized gas with the moving piston weight, said supply being movable and moving down and up along with said piston weight, continuously feeding pressurized gas from an outside source into said moving supply as the piston weight continues to move down and up in said cylinder, suddenly placing said moving supply of pressurized gas into communication with the region beneath said piston weight and above said bottom assembly during each cycle of operation as the piston weight is descending near the bottom of its stroke for suddenly injecting pressurized gas into said region for replenishing the cushion of pressurized gas to be trapped below the descending piston weight and thereafter blocking the flow of pressurized gas to said region by the piston weight as the piston weight further descends for causing the piston weight to bounce on said trapped gas for further compressing said gas with great pressure multiplication without said piston weight striking said bottom assembly, for providing a quiet but very powerful driving action, and also suddenly placing said moving supply of pressurized gas into communication with the region beneath said piston weight during each cycle of operation as the piston weight is moving upwardly, after bouncing upon said cushion of pressurized gas, for injecting additional pressurized gas beneath the ascending piston weight for boosting it up relatively high in the cylinder in readiness for providing a quiet but very powerful driving action during the next bouncing cycle.

2. In the method of driving a pile into the earth by cyclically bouncing a piston weight upon a cushion of pressurized gas trapped beneath the descending piston weight, the further invention as claimed in claim 1, including the steps of:

providing for pressure-responsive exhausting of the expanded gas from the cylinder beneath the upwardly moving piston weight, and arranging for said exhuasting to occur during each cycle of operation when the pressure of the expanding gas beneath the upwardly moving piston is reduced approximately to atmospheric pressure.

3. In the method of driving a pile into the earth by cyclically bouncing a piston weight upon a cushion of pressurized gas trapped beneath the descending piston weight, the further invention as claimed in claim 1 or 2, including the steps of:

carrying said moving supply of pressurized gas in encircling relationship around the moving piston weight and spaced above the lower end of the moving piston weight, suddenly placing said moving supply of pressurized gas into communication with said region beneath the descending piston weight and above said bottom assembly by flowing the pressurized gas from said moving supply in a bypass relationship around the lower end of the piston weight into said region below the descending piston weight, and thereafter blocking said bypass flow by the lower end of the descending piston weight when said lower end moves down farther for producing said trapping of the pressurized gas.

4. In the method of driving a pile into the earth by cyclically bouncing a piston weight upon a cushion of pressurized gas trapped beneath the descending piston weight, the further invention as claimed in claim 1 or 2, including the steps of:

carrying said moving supply of pressurized gas in encircling relationship around the moving piston weight, providing a bypass extending from a higher set of ports in the cylinder to a lower set of ports in the cylinder, using the movement of said moving supply for automatically placing said supply into communication with said region through said bypass passage whenever said moving supply has moved into communication with said higher set of ports while said lower set of ports is clear of said piston weight, and blocking said lower set of ports by the lower end of said piston weight when said lower end is below the lower set of ports.

5. In the method of driving a pile into the earth by cyclically bouncing a piston weight upon a cushion of pressurized gas trapped beneath the descending piston weight, the further invention as claimed in claim 1, including the step of:

exhausting the expanded gas from the cylinder beneath the upwardly moving piston weight in response to the pressure thereof when the pressure of the expanding gas beneath the upwardly moving piston is reduced approximately to atmospheric pressure.

6. In the method of generating a powerful downward thrust on the earth wherein a heavy piston mass moves down and bounces up in a cylinder by cyclically bouncing upon a cushion of pressurized gas trapped in a region below the descending piston weight and above a bottom assembly which is coupled in thrust-transmitting relationship with the earth, and additional pressurized gas is injected into said region during each cycle of operation as the piston weight is descending within the cylinder for replenishing the cushion of pressurized gas to be trapped below the descending piston weight for causing the piston weight to bounce thereon, and expanded gas is released from the cylinder beneath the piston weight into the atmosphere during each cycle of operation after the piston weight has moved upwardly in the cylinder, and wherein the downward thrusts of the bouncing piston weight on the cushion of trapped pressurized gas are utilized for generating the powerful downward thrust, the invention comprising the steps of:

carrying a supply of pressurized gas with the moving piston weight, said supply being movable and moving down and up along with said piston weight, continuously feeding pressurized gas from an outside source into said moving supply as the piston weight continues to move down and up in said cylinder, suddenly placing said moving supply of pressurized gas into communication with the region beneath said piston weight and above said bottom assembly during each cycle of operation as the piston weight is descending near the bottom of its stroke for injecting pressurized gas into said region for replenishing the cushion of pressurized gas to be trapped below the descending piston weight and thereafter blocking the flow of pressurized gas into the region beneath said descending piston weight by said piston weight as it descends further for causing the piston weight to bounce on said cushion for generating a powerful, quiet thrust of the order of magnitude of hundreds of thousands of pounds resulting from multiplication of the pressure in said trapped gas without said piston weight impacting against said bottom assembly, and also suddenly placing said moving supply of pressurized gas into communication with the region beneath said piston weight during each cycle of operation as the piston weight is moving upwardly after bouncing upon said cushion of pressurized gas for injecting additional pressurized gas beneath the ascending piston weight for boosting it up relatively high in the cylinder in readiness for providing a quiet but very powerful downward thrust during the next bouncing cycle.

7. In the method of generating a powerful downward thrust on the earth by cyclically bouncing a piston weight upon a cushion of pressurized gas trapped beneath the descending piston weight, the further invention as claimed in claim 6, including the steps of:

carrying said moving supply of pressurized gas in encircling relationship around the moving piston weight and spaced above the lower end of the moving piston weight, and suddenly placing said moving supply of pressurized gas into communication with said region beneath the piston weight and above said bottom assembly twice during each cycle of operation by flowing the pressurized gas from said moving supply in bypass relationship around the lower end of the piston weight.

8. In the method of generating a powerful downward thrust on the earth by cyclically bouncing a piston weight upon a cushion of pressurized gas trapped beneath the descending piston weight, the further invention as claimed in claim 6, including the steps of:

carrying said moving supply of pressurized gas in encircling relationship around the moving piston weight, providing a bypass passage extending from a higher set of ports in the cylinder to a lower set of ports in the cylinder, using the movement of said moving supply for automatically placing said supply into communication with said region through said bypass passage whenever said moving supply has moved into communication with said higher set of ports while said lower set of ports is clear of the lower end of said piston weight both during the downstroke and upstroke of said piston weight, and blocking said lower set of ports by the lower end of said piston weight whenever said lower end is below the lower set of ports, thereby providing two injections of pressurized gas into the region below the piston weight and above said bottom assembly during each cycle of operation.

9. In the method of driving a pile into the earth wherein a piston weight moves down and bounces up in a cylinder by cyclically bouncing upon a cushion of pressurized gas trapped in a region below the descending piston weight and above a bottom assembly which is coupled to the pile being driven, and additional pressurized gas is injected into said region during each cycle of operation as the piston weight is descending within the cylinder for replenishing the cushion of pressurized gas to be trapped below the descending piston weight for causing the piston weight to bounce thereon, and expanded gas is released from the cylinder beneath the piston weight into the atmosphere during each cycle of operation as the piston weight is moving upwardly in the cylinder, and wherein the downward thrusts of the bouncing piston weight on the cushion of trapped pressurized gas are utilized for driving the pile, the further invention comprising the steps of:

carrying said moving supply of pressurized gas in encircling relationship around the moving piston weight and spaced above the lower end of the moving piston weight, said supply being movable and moving down and up along with said piston weight, continuously feeding pressurized gas from an outside source into said moving supply as the piston weight continues to move down and up in said cylinder, using the movement of said moving supply for automatically suddenly placing said moving supply of pressurized gas into communication with said region beneath the descending piston weight and above the bottom assembly by bypass flow of the pressurized gas from said moving supply in a bypass relationship around the lower end of the piston weight into said region below the descending piston weight as said lower end nears the bottom assembly, using the further downward movement of the lower end of the piston closer to the bottom assembly for automatically suddenly blocking said bypass flow for trapping the pressurized gas between the descending piston weight and the bottom assembly for further compressing the pressurized gas with great pressure multiplication without impact of said piston weight against said bottom assembly for producing a quiet but very powerful driving action on the pile, further using the movement of said moving supply of pressurized gas for automatically injecting the supply by bypass flow into the region below the piston weight and above the bottom assembly as it ascends after it has bounced for boosting it up relatively high in the cylinder in readiness for providing the next quiet but very powerful driving action, exhausting the expanded gas from the cylinder beneath the upwardly moving piston weight in response to the decrease in pressure of the expanding gas beneath the upwardly moving piston when said pressure has decreased approximately to atmospheric pressure, and shutting off said exhausting when there is a sudden increase in pressure resulting from the initiation of said bypass flow.

10. In the method of driving a pile into the earth wherein a piston weight moves down and bounces up in a cylinder by cyclically bouncing upon a cushion of pressurized gas trapped in a region below the descending piston weight and above a bottom assembly coupled to the pile being driven, and additional pressurized gas is injected into said region during each cycle of operation as the piston weight is descending within the cylinder for replenishing the cushion of pressurized gas to be trapped below the descending piston weight for causing the piston weight to bounce thereon, and expanded gas is released from the cylinder beneath the piston weight into the atmosphere during each cycle of operation as the piston weight is moving upwardly in the cylinder, wherein the downward thrusts of the bouncing piston weight on the cushion of trapped pressurized gas are utilized for driving the pile, and wherein the lower end of the piston weight has piston rings encircling it, the further invention comprising the steps of:

carrying a supply of pressurized gas with the moving piston weight, said supply being movable and moving down and up along with said piston weight, said moving supply of pressurized gas being carried in encircling relationship around the moving piston weight above said piston rings, continuously feeding pressurized gas from an outside source into said moving supply as the piston weight continues to move down and up in said cylinder, providing a bypass extending from a higher set of ports in the cylinder to a lower set of ports in the cylinder, using the movement of said moving supply for automatically suddenly flowing pressurized gas from said moving supply through said bypass whenever said moving supply has moved down into communication with said higher set of ports while said lower set of ports is clear of said piston weight as the piston weight is descending near the bottom of its stroke for suddenly injecting pressurized gas into said region to replenish the cushion of pressurized gas to be trapped below the descending piston weight and thereafter blocking said bypass flow of pressurized gas to said region beneath said descending piston weight by said descending piston weight for causing the piston weight to bounce on said trapped gas for producing a powerful downward thrust on the trapped gas for compressing said trapped gas with pressure multiplication for driving the pile with no impact occurring of the piston weight against the bottom assembly, using the movement of said moving supply for automatically suddenly flowing pressurized gas from said moving supply through the bypass whenever said moving supply has moved up for clearing the lower set of ports while the moving supply is in communication with the higher set of ports as the piston weight is ascending in order to boost the piston weight back up the cylinder after it has bounced, automatically exhausting the expanded gas from the cylinder beneath the upwardly moving piston weight in response to the decrease in pressure of the expanding gas when the pressure beneath the upwardly moving piston has become reduced approximately to atmospheric pressure, and automatically starting the cycle of operation after 37 shut down" when the piston weight is in its initial rest position by turning on the feed of pressurized gas from said outside source into said supply and allowing the pressurized gas to flow from said supply into said bypass to said lower set of ports and then allowing the pressurized gas to flow from said lower set of ports down past said piston rings into the region beneath said piston weight for lifting the lower end of the piston weight above said lower set of ports for commencing the cycles of operation, whereby fully automatic quiet and very powerful pile driving is obtained by turning on said feed of pressurized gas.

11. In the method of driving a pile into the earth as claimed in claim 1, the further step of:

valving the gas from between said massive piston weight and said bottom assembly after said piston weight has bounced upon said cushion and is ascending by pressure-responsive valving action in response to decrease in pressure of the expanding gas approaching atmospheric pressure.

12. In the method of driving a pile as claimed in claim 11, the step of:

causing the communication of pressurized gas from said moving supply into said region to stop said pressure-responsive valving of the gas from between the piston weight and the bottom assembly.

13. In the method of driving a pile as claimed in claim 11, in which:

said valving of gas continues while the piston weight is descending, and said valving is stopped by the sudden communication of pressurized gas from said moving supply into said region between the descending piston weight and the bottom assembly.

14. In the method of generating a sequence of powerful downward thrusts wherein a massive piston weight moves up and down in a cylinder by bouncing during each cycle upon a suddenly injected cushion of compressible pressurized gas trapped between the descending piston weight and a bottom assembly for generating a powerful downward thrust on the bottom assembly during each bounce, the invention comprising the steps of:

carrying a supply of pressurized gas in a movable storage chamber which moves downwardly and upwardly with said massive piston weight and supplying pressurized gas from an external supply source into said movable storage chamber, suddenly passing said pressurized gas from said moving storage chamber into the region between said massive piston weight and said bottom assembly as said piston weight approaches said bottom assembly for providing said cushion, stopping said passing of pressurized gas from said storage chamber into said region by said piston weight when said piston weight is spaced closely above and is descending rapidly toward said bottom assembly for trapping the pressurized gas in said region and compressing said trapped gas for producing pressure multiplication with a relatively high compression ratio for generating a powerful downward thrust on said bottom assembly without impact occurring between said piston weight and said bottom assembly, again suddenly passing said pressurized gas from said moving storage chamber into the region between said massive piston weight and said bottom assembly as the piston ascends after bouncing upon said trapped gas in order to expedite the piston weight's movement up the cylinder, and valving the gas from between said massive piston weight and said bottom assembly after said piston weight has bounced upon said cushion and as said piston weight is ascending by pressure-responsive valving action in response to decrease in pressure of the expanding gas in the cylinder beneath the ascending piston.

15. In the method of generating a sequence of powerful downward thrusts the invention as claimed in claim 14, including the further step of:

continuing the valving of gas from the region between said piston weight and said bottom assembly until the moment when the pressurized gas is suddenly passed from said moving storage chamber into said region as the piston weight approaches said bottom assembly.

16. In the method of cyclically generating powerful downward thrusts wherein a massive piston weight moves up and down within a cylinder wall by bouncing during each cycle upon a suddenly provided cushion of compressible pressurized gas trapped between the descending piston weight and a bottom assembly for generating a powerful downward thrust on the bottom assembly during each bounce of the massive piston weight, the invention comprising the steps of:

providing a movable storage chamber for pressurized gas surrounding the massive piston weight and located between the cylinder wall and the piston weight, said movable storage chamber moving up and down along with the piston weight, supplying pressurized gas from an external source into said movable storage chamber as the storage chamber is moving up and down, as the piston weight is descending toward said bottom assembly suddenly allowing the pressurized gas to rush down from the downwardly moving storage chamber into the region below the descending piston weight between said piston weight and said bottom assembly and blocking the flow of pressurized gas into the region beneath the piston weight by the piston weight after pressurized gas has rushed into the region beneath the descending piston, for becoming trapped and compressed with large pressure multiplication for producing a powerful bouncing action with consequent generation of a powerful downward thrust on said bottom assembly during said bouncing action without impact occurring between said piston weight and said bottom assembly, as the piston weight is ascending suddenly allowing additional pressurized gas to rush from the upwardly moving storage chamber into the region below the ascending piston weight and above said bottom assembly for aiding in propelling the piston weight up relatively high, allowing expansion of the gas in the region below the piston and above said bottom assembly to continue until the expanding gas pressure has decreased toward atmospheric pressure, and when the piston weight is near the top of its stroke providing for exhaust of the expanded gas from the region below the piston weight.

17. In the method of cyclically generating powerful downward thrusts, the invention as claimed in claim 16, including the step of:

exhausting the expanded gas is provided in response to decrease of pressure within the expanding gas to a predetermined value.

18. In the method of cyclically generating powerful downward thrusts wherein a massive piston weight moves up and down in a cylinder by bouncing during each cycle upon a suddenly introduced cushion of compressible pressurized gas trapped between the descending piston weight and a bottom assembly for applying a powerful downward thrust to the bottom assembly during each bounce of the massive piston weight, the invention comprising the steps of:

carrying a supply of pressurized gas in a movable storage chamber which moves downwardly and upwardly with said massive piston weight, supplying pressurized gas from an external source into said movable storage chamber as the movable storage chamber is moving up and down, allowing said pressurized gas to rush suddenly down from the downwardly moving storage chamber into the region between said massive piston weight and said bottom assembly as said piston weight is moving down and is approaching said bottom assembly, thereafter allowing the further downward movement of said piston weight to block communication between said moving storage chamber and said region for providing said trapped cushion upon which the massive piston weight bounces with great pressure multiplication producing a pressure in said trapped gas greater than the pressure of the pressurized gas as supplied from said external source for applying the powerful downward thrust to the bottom assembly without impact between said piston weight and said bottom assembly, also, after the piston weight has bounced, allowing said pressurized gas to rush suddenly down from the upwardly moving storage chamber into the region between said massive piston weight and said bottom assembly in order to boost the rising piston weight as it moves up toward the top portion of the cylinder, and valving the expanded gas from between said massive piston weight and said bottom assembly after said piston weight has bounced upon said cushion and has moved up near the top of its stroke for commencing the next bouncing cycle.

19. In the method of cyclically generating powerful downward thrusts, the invention as claimed in claim 18, in which:

the valving of the expanded gas occurs in response to decrease of pressure within the expanding gas to a predetermined value.

20. In the method of cyclically generating powerful downward thrusts wherein a massive piston weight moves up and down in a cylinder by bouncing during each cycle upon a suddenly introduced cushion of compressible pressurized gas trapped between the descending piston weight and a bottom assembly for applying a powerful downward thrust to the bottom assembly during each bounce of the massive piston weight, the novel method comprising the steps of:

carrying a supply of pressurized gas in a movable storage chamber which moves downwardly and upwardly with said massive piston weight, supplying pressurized gas from an external source into said movable storage chamber as the movable storage chamber is moving up and down, allowing said pressurized gas to rush suddenly down from the downwardly moving storage chamber into the region between said massive piston weight and said bottom assembly as said piston weight is moving down and is approaching said bottom assembly and blocking the flow of pressurized gas into the region beneath said piston weight by said descending piston weight for providing said trapped cushion upon which the massive piston weight bounces without striking said bottom assembly, with pressure multiplication in said trapped cushion of gas for applying the powerful downward thrust to the bottom assembly, allowing more of the pressurized gas to rush suddenly down from the upwardly moving storage chamber into the region between said piston weight and said bottom assembly as said piston weight is moving upwardly for boosting the upwardly moving piston weight up to a relatively high stroke, and allowing the expanded gas to begin exhausting from below the piston weight when it is near the top of its stroke for commencing the next bouncing cycle.

21. In the method of cyclically generating powerful downward thrusts, the novel method as claimed in claim 20, in which:

the expanded gas is allowed to begin exhausting when its pressure has descreased to a predetermined value.

22. In the method wherein a powerful thrust is generated by a descending piston weight impacting against a suddenly introduced cushion of compressible pressurized gas trapped between the descending piston weight and a bottom assembly mechanically coupled to the earth for applying a powerful downward thrust to the bottom assembly during the bounce of the massive piston weight against the trapped compressed gas, the invention comprising the steps of:

carrying a supply of pressurized gas in a movable storage chamber which moves downwardly with said massive piston weight, supplying pressurized gas from an external source into said movable storage chamber as the movable storage chamber is moving, allowing said pressurized gas to rush suddenly down from the descending storage chamber into the region between said massive piston weight and said bottom assembly as said piston weight is descending and is approaching said bottom assembly and blocking the flow of pressurized gas into the region beneath said piston weight by said descending piston weight for providing said trapped cushion upon which the massive piston weight impacts without striking said bottom assembly for applying the powerful downward thrust to the bottom assembly with pressure multiplication occurring in said trapped cushion of gas, also, after the piston weight has bounced, allowing said pressurized gas to rush suddenly down from the upwardly moving storage chamber to the region between said massive piston weight and said bottom assembly for boosting the piston weight up the cylinder, and valving the expanded gas from between said massive piston weight and said bottom assembly after said piston weight has bounced upon said cushion and has moved up.

23. In the method of generating a powerful thrust against a bottom assembly mechanically coupled to the earth, the invention as claimed in claim 22, in which:

the valving of the expanded gas occurs in response to decrease of pressure within the expanding gas to a predetermined value.

24. In the method wherein a powerful thrust is generated by a descending piston weight impacting against suddenly introduced compressible pressurized gas trapped between the descending piston weight and a bottom assembly coupled to the earth for applying a powerful downward thrust on the bottom assembly, the invention comprising the steps of:

carrying a supply of pressurized gas in a movable storage chamber which moves downwardly with said massive piston weight, supplying pressurized gas from an external source into said movable storage chamber, allowing said pressurized gas to rush suddenly down from the descending storage chamber into the region between said massive piston weight and said bottom assembly as said piston weight is descending and is approaching said bottom assembly and blocking the flow of pressurized gas into the region beneath the piston weight by the descending piston weight for providing pressure multiplication in the trapped compressible pressurized gas upon which the massive piston weight impacts for applying the powerful downward thrust to the bottom assembly, also allowing said pressurized gas to rush suddenly down from the ascending storage chamber into the region between said massive piston weight and said bottom assembly as the piston weight is receding from said bottom assembly for boosting the piston weight upwardly, and removing the expanded gas from between said massive piston weight and said bottom assembly after said piston weight has bounced upon said cushion, has been boosted and has moved up.

* * * * *